US005642717A

United States Patent [19]

Gilman et al.

[11] Patent Number: 5,642,717

[45] Date of Patent: Jul. 1, 1997

[54] TEMPERATURE SENSING SYSTEM FOR AN INTERNAL COMBUSTION ENGINE

[75] Inventors: Dale M. Gilman, Clawson; Lang So Ngo, Dearborn, both of Mich.

[73] Assignee: Ford Motor Company, Dearborn, Mich.

[21] Appl. No.: 673,544

[22] Filed: Apr. 7, 1996

[51] Int. Cl.[6] ..... F02D 7/00

[52] U.S. Cl. ..... 123/481; 374/185

[58] Field of Search ..... 123/481, 480, 123/198 DB, 198 DC, 198 F; 374/185, 186; 338/28; 73/35

[56] References Cited

U.S. PATENT DOCUMENTS

| | | | |
|---|---|---|---|
| 2,484,585 | 10/1949 | Quinn | 338/25 |
| 3,592,061 | 7/1971 | Schwedland | 73/343 R |
| 3,681,990 | 8/1972 | Barrett et al. | 73/35 |
| 3,696,676 | 10/1972 | Butter | 73/343 R |
| 3,886,912 | 6/1975 | Haglund | 73/347 |
| 3,919,680 | 11/1975 | Ueno et al. | 338/28 |
| 4,156,841 | 5/1979 | Barnhart | 324/54 |
| 4,244,221 | 1/1981 | Scott | 73/349 |
| 4,476,711 | 10/1984 | Gutterman | 73/35 |
| 4,492,948 | 1/1985 | Clayton et al. | 338/25 |
| 5,201,840 | 4/1993 | Sausner et al. | 374/145 |
| 5,293,877 | 3/1994 | O'Hara et al. | 128/736 |
| 5,492,100 | 2/1996 | Ishii et al. | 123/481 |
| 5,555,871 | 9/1996 | Gopp et al. | 123/481 |

*Primary Examiner*—Raymond A. Nelli
*Attorney, Agent, or Firm*—Neil P. Ferraro

[57] ABSTRACT

A temperature sensing system for an internal combustion engine includes a cylinder head temperature sensor. The temperature sensor has an elongate portion such that when the sensor is installed in the cylinder head, the elongate portion is axially deformed by a predetermined amount to provide a thermally conductive engagement with the cylinder head.

17 Claims, 3 Drawing Sheets

TEMPERATURE SENSING SYSTEM FOR AN INTERNAL COMBUSTION ENGINE

FIELD OF THE INVENTION

The present invention relates generally to a temperature sensing system for sensing temperature in an internal combustion engine, and, more particularly, to a cylinder head temperature sensor.

BACKGROUND OF THE INVENTION

Modern automotive engines typically rely on numerous engine parameters for correct engine operation. Optimum engine parameters are generally stored in the memory of an engine controller. Sensors on the engine are used to sense actual engine parameters while the controller compares these sensed values to the stored optimum valves. As a result, it is important that a reliable, repeatable sensor be installed in the engine having little engine-to-engine variation, such that a correct engine operating parameter is sensed.

Various sensors for sensing the temperature of a rigid body, such as a cylinder head of an internal combustion engine, have been developed. The sensor must be in intimate thermal contact with the rigid body to sense the proper temperature. To provide good thermal conductivity, some sensor designs utilize a conductive paste applied on the exterior of the sensor. Other sensor designs utilize a spring such that, when installed, the spring provides a force to bias the sensor into contact with the rigid body to establish adequate thermal conductivity. Still other sensor designs rely on the mounting threads to provide the conductive path between the rigid body and the sensor.

The inventors of the present invention have recognized disadvantages with these prior art sensors. For example, in addition to being more costly sensor assemblies, variations in sensed temperature may result. In the spring loaded sensor design, manufacturing variations in the spring itself or deterioration of the spring rate over time may cause a change in the spring force, thereby causing a variation in sensed temperature. In the case of using a thermally conductive paste on the exterior of the sensor, the paste may migrate from the desired location or may degrade over time. A disadvantage with the sensors that rely on the mounting threads as the conductive path is that the sensors are generally unreliable due to manufacturing variations. In addition, packaging issues arise. Generally, the space in the cylinder head near the combustion chamber for mounting the sensor is limited and thus providing receiving threads at this location may not be practical.

SUMMARY OF THE INVENTION

An object of the present invention is to sense cylinder head temperature with a temperature sensor that is in reliable, repeatable thermally conductive engagement with the cylinder head.

This object is achieved and disadvantages of prior art approaches overcome by providing a novel temperature sensing system for sensing cylinder head temperature in an internal combustion engine. In one particular aspect of the invention, the engine has a cylinder block with a piston reciprocally housed in a cylinder formed therein. A cylinder head having a fire deck is mounted to the cylinder block so as to close the outer end of the cylinder, thereby defining a combustion chamber between the cylinder head fire deck and the top of the piston. The temperature sensing system includes a temperature sensor having an elongate portion in operative contact with the cylinder head for sensing the temperature of the cylinder head such that, when installed, the elongate portion is axially deformed by a predetermined amount, to provide a thermally conductive engagement with the cylinder head.

In a preferred embodiment, the elongate portion includes a tubular member having a closed end with a heat sensing element disposed therein. The heat sensing element is spaced from the closed end such that when the elongate portion is axially deformed, the heat sensing element remains substantially undeformed.

An advantage of the present invention is that a low cost temperature sensing system is provided.

Another advantage of the present invention is that a predetermined contact force is applied between the temperature sensor and the cylinder head.

Another advantage of the present invention is that a reliable, repeatable thermally conductive engagement is provided, thereby reducing variation in sensed temperature.

Still another advantage of the present invention is that the possibility of damage to the heat sensing element is reduced.

Yet another advantage of the present invention is that the temperature sensor may be placed in a confined area within the cylinder head.

Other objects, features and advantages of the present invention will be readily appreciated by the reader of this specification.

BRIEF DESCRIPTION OF THE DRAWINGS

The invention will now be described, by way of example, with reference to the accompanying drawings, in which.

DETAILED DESCRIPTION OF THE PREFERRED EMBODIMENT

Figure 1:
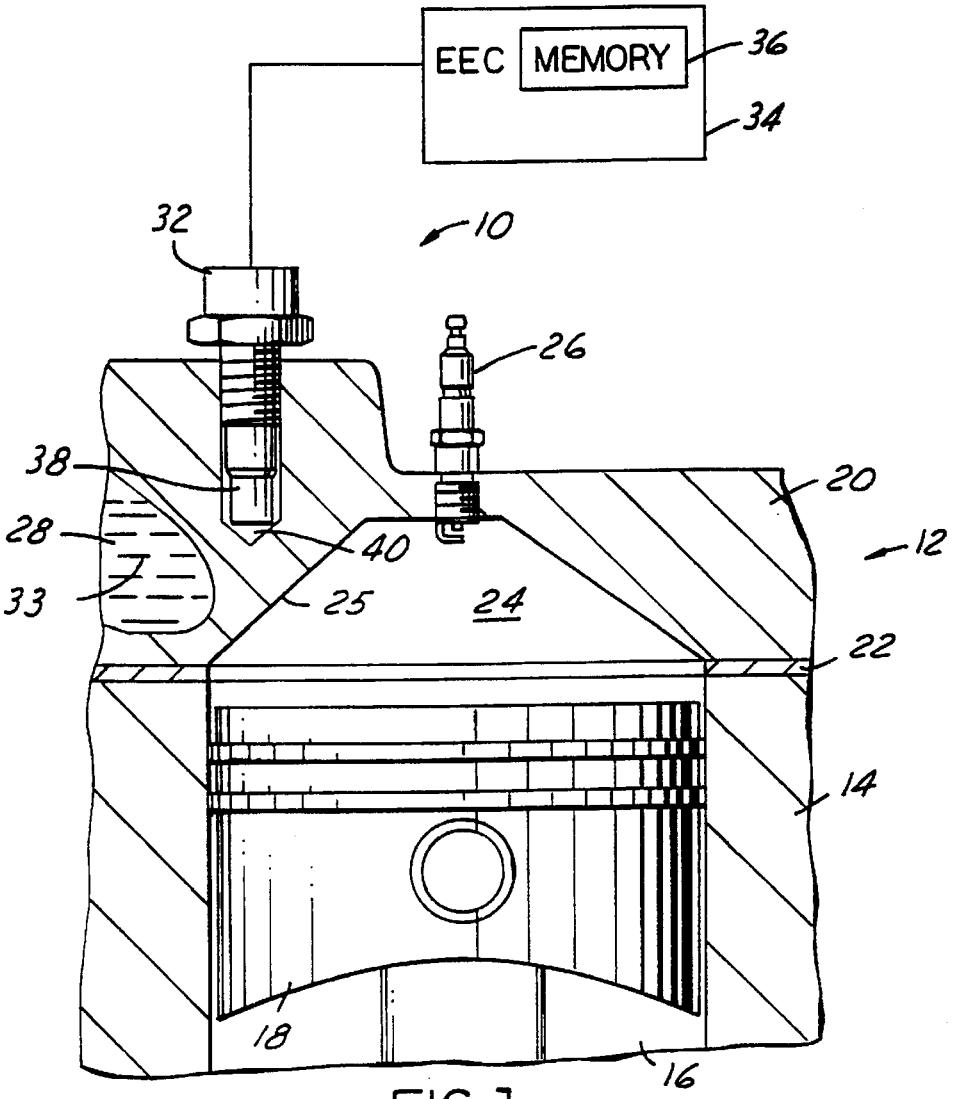
FIG. 1 is a diagrammatic partial cross-sectional view of an internal combustion engine prior to final installation of a temperature sensing system according to the present invention.
Figure 2:
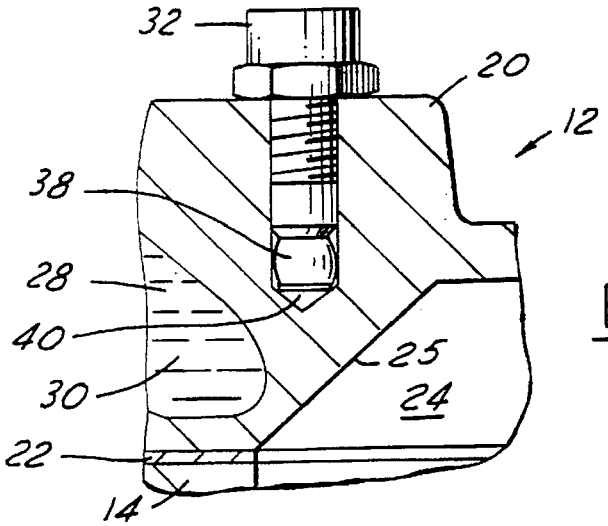
FIG. 2 is a diagrammatic partial cross-sectional view of a portion of the internal combustion engine after installation of a temperature sensing system according to the present invention.

Temperature sensing system 10, shown in FIGS. 1 and 2, detects cylinder head temperature (CHT) of internal combustion engine 12. Engine 12 includes cylinder block 14 having cylinder 16 formed therein and piston 18 reciprocally housed within cylinder 16. Cylinder head 20 is mounted to cylinder block 14, with cylinder head gasket 22 disposed therebetween, such that cylinder head 20 closes the outer end of cylinder 16, thereby defining combustion chamber 24 between the top of piston 18 and fire deck 25 of cylinder head 20. Sparkplug 26 is fastened to cylinder head 20 to communicate with combustion chamber 24. Coolant passage 28 is formed in cylinder head 20 such that coolant 30 circulates therein to cool engine 12.

According to the present invention, sensor 32 communicates with cylinder head 20 near fire deck 25 adjacent combustion chamber 24. Temperature sensor 32 senses CHT and relays the information to engine controller 34 having memory storage device 36. Controller 34 may comprise a conventional engine control microprocessor known to those skilled in the art, or a stand-alone processor, as desired. It is desirable to place sensor 32 in intimate contact with cylinder head 20. To accomplish this according to the present invention, temperature sensor 32 has elongate portion 38 extending within bore 40 of cylinder head 20 (FIG. 1). When temperature sensor 32 is installed (FIG. 2), elongate portion 38 is axially deformed by a predetermined amount, as will be further described hereinafter. This axial deformation produces a desired predetermined contact force such that temperature sensor 32 is placed in thermally conductive engagement with cylinder head 20. As a result, a reliable, repeatable sensor is installed in the engine having little engine-to-engine variation, such that a correct temperature is sensed.

Figure 3:
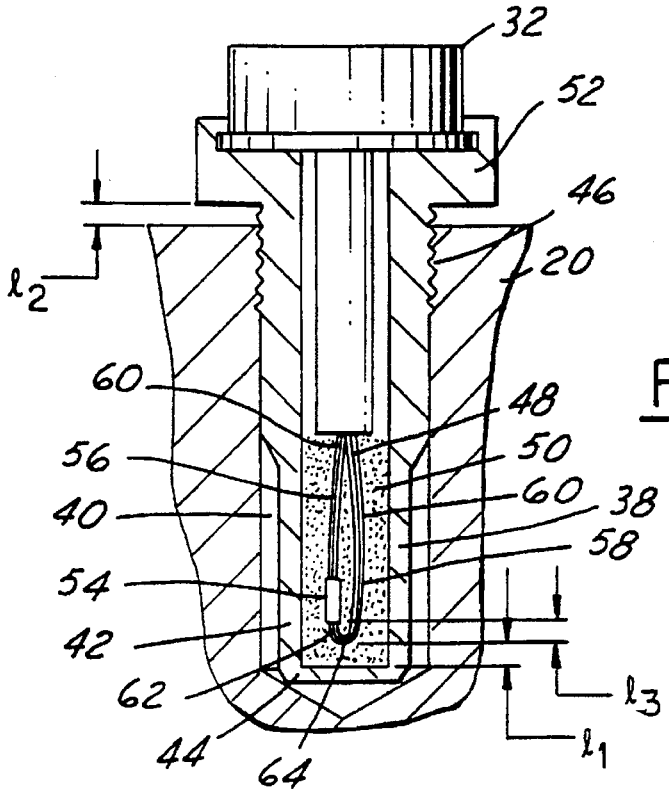
FIG. 3 is a cross-sectional view of a temperature sensor prior to final installation according to the present invention.
Figure 4:
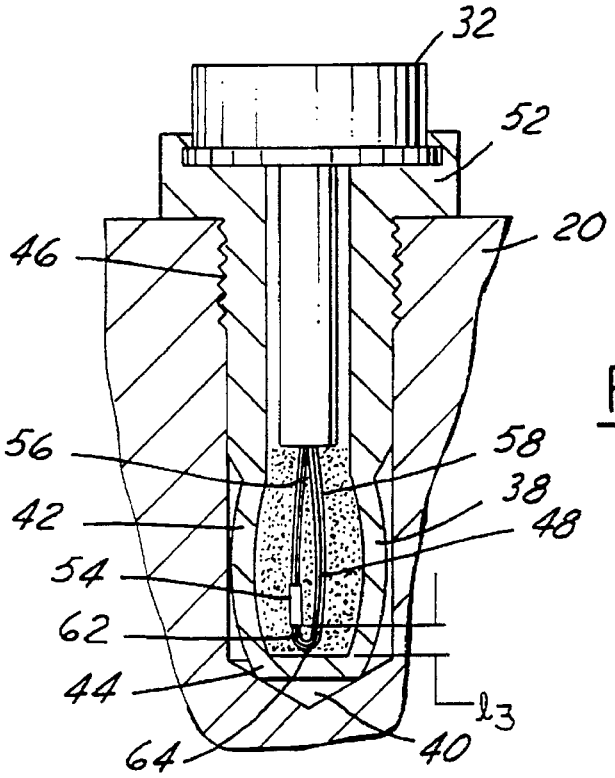
FIG. 4 is a cross-sectional view of a temperature sensor after installation according to the present invention.

Referring in particular to FIGS. 3 and 4, elongate portion 38 of temperature sensor 32 includes brass tubular member 42 having closed end 44 at one end thereof and threaded portion 46 at another end thereof. When sensor 32 is fully threaded into bore 40, elongate portion 38 is axially deformed such that end 44 engages the bottom of bore 40 in thermally conductive engagement. According to the present invention, bore 40 need not have a flat bottom to engage end 44, but instead may have a standard drill point.

Continuing with reference to FIGS. 3 and 4, heat sensing element 48, such as a thermistor assembly, is disposed inside tubular member 42. Conductive medium 50, such as a conductive grease or paste, fills tubular member 42 to aid in transferring heat from tubular member 42 to thermistor assembly 48. According to the present invention, thermistor assembly 48 is spaced from closed end 44 of tubular member 38 by a distance indicated as $l_1$ (FIG. 3). This distance is greater than the maximum amount of axial deformation. That is, $l_2$, which represents the distance between shoulder 52 of sensor 32 and the top of cylinder head 20, is less than $l_1$. Thus, when sensor 32 is fully threaded into bore 40 such that shoulder 52 abuts the top of cylinder head 20 and tubular member 42 is axially deformed, thermistor assembly 48 remains substantially undeformed (see FIG. 4).

In a preferred embodiment, thermistor assembly 48 includes body 54 and first and second electrical leads 56, 58 connected to body 54. Each lead 56, 58, as well as body 54, may be electrically insulated with insulation 60. Electrical lead 58 is formed with a generally U-shaped bend 62, having base 64, such that body 54 is formed to one side. That is, body 54 does not rest against end 44 when sensor 32 is installed and is thereby protected from possible damage. Indeed, according to the present invention, base 64 is spaced a distance $l_3$, about 3 mm, from diode body 54.

Figure 5:
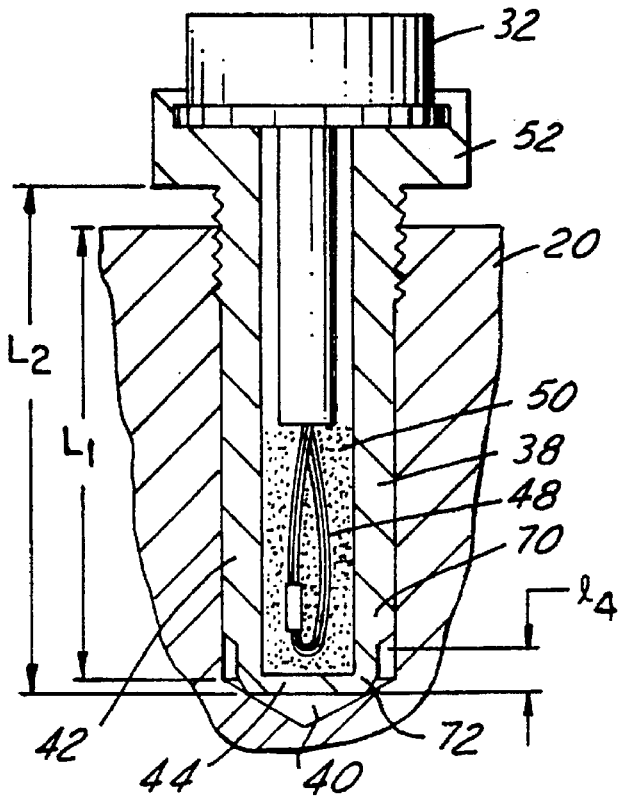
FIG. 5 is a cross-sectional view of an alternative embodiment of a temperature sensor prior to final installation according to one aspect of the present invention; and, FIG. 6 is a control flow chart according to one aspect of the present invention.

Turning now to FIG. 5, an alternative embodiment according to the present invention is shown. Here, the amount of axial deformation is controlled, not by the distance between shoulder 52 and the top of cylinder head 20 (shown as $l_2$ in FIG. 3), but by a variably deformable tubular member 42. This may be accomplished by providing tubular member 42 with varying material properties or, in a preferred embodiment, providing tubular member 42 with a relatively thick wall portion 70 and a relatively thin wall portion 72. The transition between the two wall portions 70, 72 is spaced a distance $l_4$ from end 44, shown in FIG. 5. Thus, when sensor 32 is installed in bore 40 having a length $L_1$ less than the length of tubular member 42, shown as $L_2$, the total amount of axial deformation is limited to the distance between end 44 and the transition between wall portions 70, 72, shown as $l_4$. As discussed above with reference to FIGS. 3 and 4 , thermistor assembly 48 is spaced from end 44 such that when tubular member 42 is axially deformed, thermistor assembly 48 remains undeformed.

Figure 6:
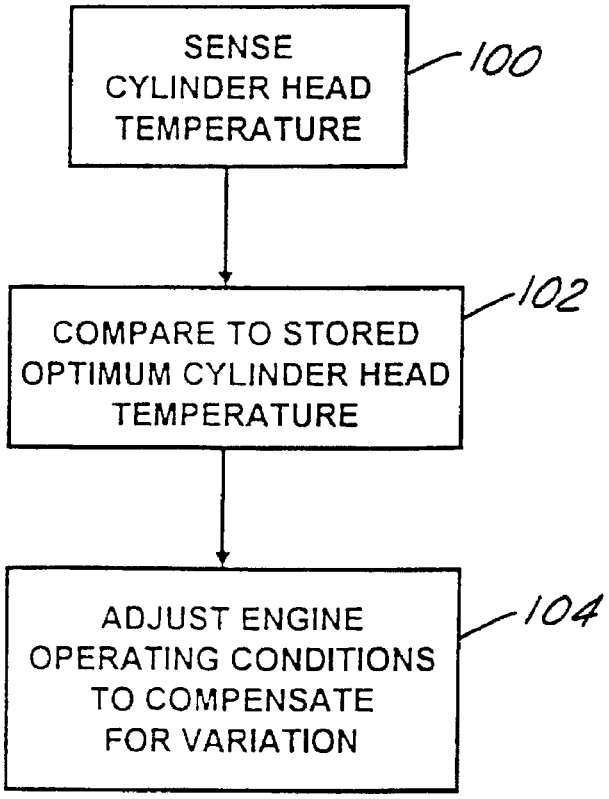

According to one aspect of the present invention, engine controller 34 is connected to sensor 32 (see FIG. 1). Controller 34 may provide corrective action to reduce the likelihood of engine problems resulting from increased CHT sensed by temperature sensor 32. This is shown in FIG. 6. At step 100, controller 34 receives a signal from temperature sensor 32 representative of CHT. At step 102, controller 34 compares this signal to a signal stored in memory 36 representative of an optimum CHT. At step 104, controller 34 adjusts the engine operating strategy to compensate for any variation between sensed CHT and stored optimum CHT. For example, controller 34 may deactivate some of the cylinders to allow continued operation of engine 12 for a period of time before repair.

While the best mode for carrying out the invention has been described in detail, those skilled in the art in which this invention relates will recognize various alternative designs and embodiments, including those mentioned above, in practicing the invention that has been defined by the following claims.

We claim:

1. A temperature sensing system for sensing cylinder head temperature in an internal combustion engine, with the engine having a cylinder block having a piston reciprocally housed in a cylinder formed therein, and a cylinder head having a fire deck, with the cylinder head being mounted to the cylinder block so as to close the outer end of the cylinder thereby defining a combustion chamber between the cylinder head fire deck and the top of the piston, with said system comprising:

a temperature sensor having an elongate portion in operative contact with the cylinder head for sensing the temperature of the cylinder head such that, when installed, said elongate portion is axially deformed by a predetermined amount, to provide a thermally conductive engagement with the cylinder head.

2. A system according to claim 1 wherein said elongate portion comprises a tubular member having a closed end and a heat sensing element disposed therein, with said heat sensing element being spaced from said closed end such that when said elongate portion is axially deformed, said heat sensing element remains substantially undeformed.

3. A system according to claim 1 wherein said elongate portion extends within a bore in the cylinder head near the fire deck.

4. A system according to claim 3 further comprising a shoulder attached to said threaded portion wherein said predetermined amount is defined by a space between said cylinder head and said shoulder.

5. A system according to claim 2 further comprising a thermally conductive medium disposed between said heat sensing element and said tubular member.

6. A system according to claim 2 wherein said heat sensing element comprises a thermistor assembly having a body, a first electrical lead connected to said body and extending in a first direction and a second electrical lead connected to said body and partially extending in a second direction opposite said first direction, with said second lead then extending in a generally similar direction as said first direction, thereby defining a generally U-shaped bend in said second electrical lead.

7. A system according to claim 6 wherein said electrical leads are electrically insulated from said tubular member.

8. A system according to claim 1 further comprising a controller, with said controller receiving a signal which is representative of the temperature of the cylinder head, and with said controller comparing said received signal to a stored signal which is representative of an optimum cylinder head temperature, and thereafter adjusting an engine operating strategy to compensate for variation between said received signal and said stored signal.

9. An internal combustion engine comprising:

a cylinder block having a piston reciprocally housed in a cylinder formed therein;

a cylinder head having a fire deck, with said cylinder head mounted to said cylinder block so as to close the outer end of said cylinder thereby defining a combustion chamber between said cylinder head fire deck and the top of said piston; and a temperature sensor having an elongate portion in operative contact with said cylinder head for sensing the temperature of said cylinder head, with said sensor having a threaded portion such that when said sensor is threaded to said cylinder head, said elongate portion is axially deformed by a predetermined amount to provide a thermally conductive engagement with said cylinder head.

10. An engine according to claim 9 further comprising a bore formed in said cylinder head near said fire deck for receiving said elongate portion of said temperature sensor.

11. An engine according to claim 10 further comprising a shoulder attached to said sensor wherein said predetermined amount is defined by a space between said cylinder head and said shoulder.

12. An engine according to claim 9 further comprising a controller, with said controller receiving a signal which is representative of the temperature of said cylinder head, and with said controller comparing said received signal to a stored signal representative of an optimum cylinder head temperature and generating a signal which is representative of the variation between said received signal and said stored signal, and thereafter adjusting an engine operating strategy to compensate for said variation.

13. A temperature sensor comprising:

a tubular elongate portion having a closed end;

a thermistor assembly disposed in said tubular portion and spaced from said closed end, with said thermistor assembly comprising:

a body;

a first electrical lead connected to said body and extending in a first direction;

a second electrical lead connected to said body and partially extending in a second direction opposite said first direction, with said second lead then extending in the same direction as said first direction thereby defining a generally U-shaped bend in said second electrical lead;

with said tubular elongate portion being variably deformable such that when secured in a bore having a length less than the length of said tubular elongate portion, said tubular elongate portion is axially deformed by a predetermined amount to provide a thermally conductive engagement within the bore and said thermistor assembly remains substantially undeformed.

14. A temperature sensor according to claim 13 wherein said tubular member has a variable wall thickness.

15. A temperature sensor according to claim 14 wherein said variable wall thickness comprises a relatively thin wall and a relatively thick wall, with said predetermined amount of deformation being defined by the distance between said closed end and a transition between said thin wall and said thick wall.

16. A temperature sensor according to claim 13 further comprising a thermally conductive medium disposed between said thermistor assembly and said elongate tubular member.

17. A system according to claim 13 wherein said thermistor assembly is electrically insulated from said tubular elongate portion.

* * * * *